United States Patent [19]

Beckley et al.

[11] Patent Number: 4,924,052

[45] Date of Patent: May 8, 1990

[54] PROCESSING GRAIN-ORIENTED "ELECTRICAL" STEEL

[75] Inventors: Philip Beckley, Bettws Hill; David Snell, Six Bells, both of United Kingdom

[73] Assignee: British Steel Plc, London, United Kingdom

[21] Appl. No.: 319,041

[22] Filed: Mar. 6, 1989

[30] Foreign Application Priority Data

Mar. 5, 1988 [GB] United Kingdom ..... 8805296

[51] Int. Cl.[5] ..... B23K 9/04; H01F 1/04

[52] U.S. Cl. ..... 219/75; 148/111; 219/137 R

[58] Field of Search ..... 219/75, 127, 136, 137 R; 148/111

[56] References Cited

U.S. PATENT DOCUMENTS 2,630,513 3/1953 Redmond ..... 219/136

3,787,657 1/1974 Denis et al. ..... 219/127

4,652,316 3/1987 Beckley ..... 148/111

4,767,469 8/1988 Salsgiver et al. ..... 148/111

FOREIGN PATENT DOCUMENTS 2208871A 4/1989 United Kingdom .

OTHER PUBLICATIONS

T. Lyman, Editor, *Metals Handbook*, vol. 6, *Welding & Brazing*, 1971, pp. 120–121 & 123.

*Primary Examiner*—Clifford C. Shaw

*Attorney, Agent, or Firm*—Bacon & Thomas

[57] ABSTRACT

A method of forming continuous or spot-sequenced lines across the surface of grain oriented steel strip by spark discharge from electrodes closely spaced from said strip, characterized in that the atmosphere through which the discharge is effected is inert. Preferably the inert atmosphere is nitrogen but other gases, e.g. argon may readily be employed.

7 Claims, 1 Drawing Sheet

PROCESSING GRAIN-ORIENTED "ELECTRICAL" STEEL

This invention relates to high permeability grain-oriented 'electrical' steel, that is steel strip used for electromagnetic applications e.g. to form a magnetic circuit in electrical machines. Processing such steel in a known manner promotes the growth of large grains within the steel and preferential orientation of same leading to enhanced magnetic characteristics.

A problem associated with the manufacture of such grain oriented steel is that production of optimum grain alignment tends to lead at the same time to grains of larger than optimum size which is detrimental in the sense that the magnetic domain wall spacing within the grain becomes so large that, in use, rapid movement of the domain walls (caused by the greater distance to be moved by these walls in unit time) create severe micro-eddy currents which in turn cause severe power loss.

It is known to overcome this problem by providing artificial barriers which simulate the effect of grain boundaries in the strip, reducing the domain spacing and thus reducing the movement of the domain walls. Typically such barriers are produced by forming lines or spots across the surface of the strip by electrical-discharge means, e.g. spark ablation, as described in our UK Pat. Nos. 2146567 and 2208871.

The electrodes usually employed are in the form of high melting point wires e.g. tungsten, tungsten carbide or thoriated tungsten, between say 0.5 mm and 1.5 mm in diameter. However the wear rate of such electrodes is significant and in high volume, continuous production schemes this leads to frequent interruptions for replacement/adjustment and consequent losses in efficiency. It is an object of this invention to mitigate this problem.

The present invention provides a method of forming continuous or spot-sequenced lines across the surface of grain oriented steel strip by spark discharge from electrodes closely spaced from said strip, characterised in that the atmosphere through which the discharge is effected is inert.

Preferably the inert atmosphere is nitrogen but other gases, e.g. argon may readily be employed. The electrodes may be tungsten wire.

The use of nitrogen or other non-oxidising gas prevents the oxidation of the tungsten thus conserving wear or erosion since tungsten oxide has a lower melting point than tungsten itself. Additionally the generation of ozone, as with electrical discharge in air, is eliminated thus conserving the insulation properties of the conventional plastics materials associated with the electrical system of the sparking devices which is otherwise adversely affected by ozone. Ducting may be provided to extract nitrogen oxide from the working environment.

Practically it has been found that under like conditions, compared with spark ablation conducted under an atmosphere of air, electrode wear effected under conditions according to this invention is reduced tenfold.

In order that the invention may be fully understood one embodiment thereof will now be described with reference to the accompanying drawing in which.

Figure 1:
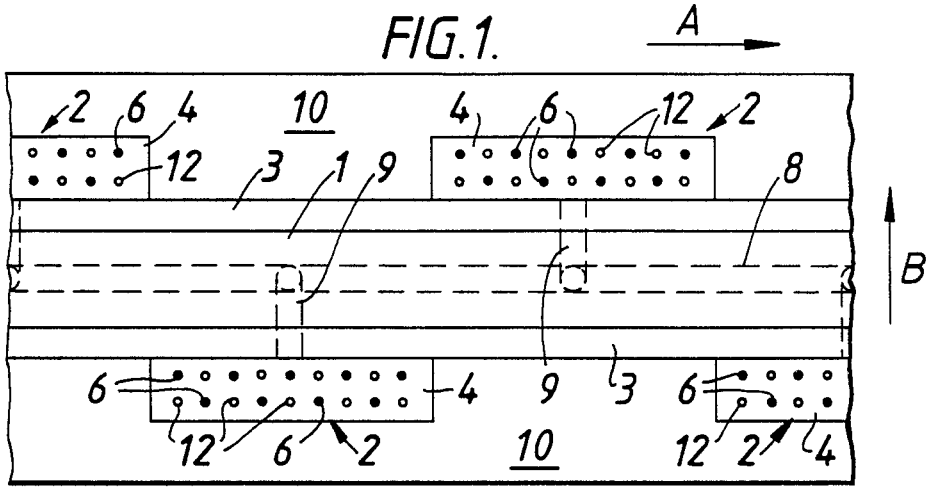
FIG. 1 is a plan view of part of the apparatus for performing this invention.
Figure 2:
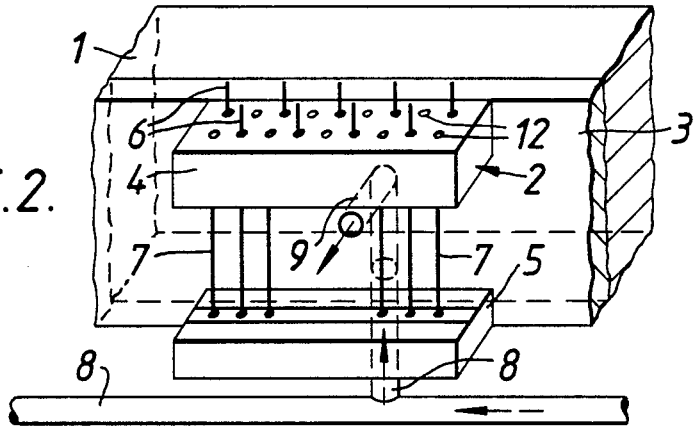
FIG. 2 is a part-disassembled schematic side view of the apparatus.
Figure 3:
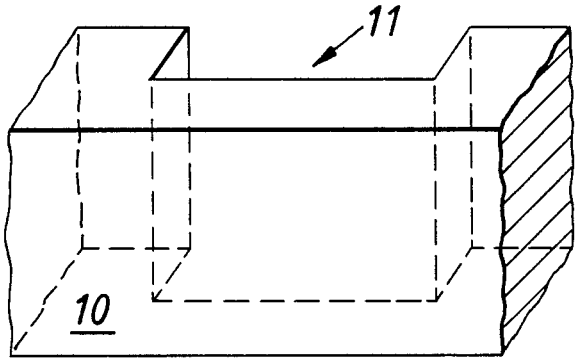
FIG. 3 is a schematic side view of part of this apparatus.

Referring to the drawings, a support beam 1 has ten sets of electrode banks 2 mounted in staggered relationship, five on each side and each insulated from the beam 1 by plates 3. Each electrode bank comprises two separate blocks 4,5, the electrodes 6 extending from the block 4 and the cables 7 supplying power thereto being clamped in the block 5. A space or reservoir for gas injected via piping 8 and channels 9 is thus created between these blocks 4,5, the whole being sealed by side members 10 which have recesses 11 formed in them to envelope the blocks. A number of holes 12 extend through the block 4 having orifices interspersed with the electrodes so that the gas issuing therefrom envelopes same.

The steel strip passes in a stepwise fashion alongside the top of the electrodes in the direction shown by arrow A and, in the intervals between this motion the support beam traverses the strip in the direction shown by arrow B, this direction alternating in the intervals between successive steps. Complete coverage of the strip is thus achieved.

The electrode/strip surface gap may be between 1 mm and 2 mm with the electrodes between say 1 mm and 2 mm in diameter and spaced apart by about 10 mm. With the strip being indexed one metre at a time the scribed line spacing generated when the beam traverses the strip is 5 mm.

It is to be understood of course that electrode materials other than those disclosed may alternatively be used, indeed with nitrogen shrouding materials which could not be used hitherto in air may be employed with advantage; additionally, electrodes with diameters other than those indicated may be employed as indeed may different spacings be used.

We claim:

1. A method of forming continuous or spot sequenced lines across the surface of grain oriented steel strip comprising applying spark discharge to said strip from electrodes closely spaced from said strip through an inert atmosphere comprising nitrogen.

2. Apparatus for forming continuous or spot-sequenced lines across the surface of grain oriented steel strip, comprising banks of electrodes closely spaced for said strip said banks of electrodes being movable transversely to said strip and energised to produce said lines by spark discharge, means for injecting an inert gas to envelope the electrodes throughout the spark discharge.

3. Apparatus according to claim 2, to which the electrodes comprise wires 1.0 mm to 1.5 mm in diameter.

4. Apparatus according to claim 3, in which the wires are tungsten, tungsten carbide or thoriated tungsten.

5. Apparatus according to claim 2, in which the banks of electrodes are mounted on opposite sides of a common beam along which the gas is channelled.

6. Apparatus according to claim 2, further comprising means for moving the strip in a stepwise mode past the electrode banks on said beam.

7. Apparatus according to claim 2, further comprising means for reciprocable movement of said beam across the strip during pauses in the strip movement.

* * * * *